US007721519B2

(12) United States Patent
Grecksch et al.

(10) Patent No.: US 7,721,519 B2
(45) **Date of Patent: *May 25, 2010**

(54) METHOD FOR THE PRODUCTION OF A FANCY YARN

(75) Inventors: Hans Grecksch, Mönchengladbach (DE); Gerhard Rienas, Heinsberg (DE); Christoph Haase, Viersen (DE); Olav Birlem, Schwalmtal (DE); Iris Biermann, Mönchengladbach (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 977 days.

This patent is subject to a terminal disclaimer.

(21) Appl. No.: 10/586,817

(22) PCT Filed: Dec. 29, 2004

(86) PCT No.: PCT/EP2004/014782

§ 371 (c)(1),
(2), (4) Date: Jul. 20, 2006

(87) PCT Pub. No.: WO2005/071150

PCT Pub. Date: Aug. 4, 2005

(65) Prior Publication Data

US 2008/0243288 A1 Oct. 2, 2008

(30) Foreign Application Priority Data

Jan. 21, 2004 (DE) ..... 10 2004 003 032

(51) Int. Cl.
*D02G 3/02* (2006.01)
*D02G 3/22* (2006.01)

(52) U.S. Cl. ..... 57/264; 57/91; 57/209; 57/317

(58) Field of Classification Search ..... 57/264, 57/265, 317, 91, 209; 700/139
See application file for complete search history.

(56) References Cited

U.S. PATENT DOCUMENTS

| | | | | |
|---|---|---|---|---|
| 5,509,261 | A | 4/1996 | Wassenhoven et al. | 57/263 |
| 7,386,975 | B2 * | 6/2008 | Biermann | 57/265 |
| 2007/0137165 | A1 * | 6/2007 | Biermann et al. | 57/264 |

FOREIGN PATENT DOCUMENTS

| | | | |
|---|---|---|---|
| DE | 40 41 301 | A1 | 6/1992 |
| DE | 44 04 503 | A1 | 9/1994 |
| DE | 197 16 510 | A1 | 10/1998 |
| DE | 100 26 389 | A1 | 3/2001 |

* cited by examiner

*Primary Examiner*—Shaun R Hurley
(74) *Attorney, Agent, or Firm*—K&L Gates LLP

(57) ABSTRACT

A method which improves the correspondence between the produced fancy yarn and the predetermined configuration of said fancy yarn. The fancy yarn is guided through a sensor device in a spinning device after it is formed and the diameter of the fancy yarn is continuously measured by the sensor device. The fancy configuration of the produced yarn is determined on the basis of the measured values of the diameter and is compared with the predetermined fancy configuration. The comparison is carried out until sufficient correspondence between the predetermined fancy configuration and the fancy configuration of the optimized, produced yarn is achieved.

16 Claims, 5 Drawing Sheets

METHOD FOR THE PRODUCTION OF A FANCY YARN

CROSS-REFERENCES TO RELATED APPLICATIONS

This application claims the benefit of German patent application 102004003032.4, filed Jan. 21, 2004, herein incorporated by reference.

BACKGROUND OF THE INVENTION

The invention relates to a method for the production of a fancy yarn, particularly such a method in which an effect configuration is predetermined and data is generated therefrom representing the selected effect configuration, and spinning adjustments are generated based on this data.

A yarn is called a fancy yarn, in which thick locations are present with predetermined larger diameters and with predetermined lengths, the so-called effects. The yarn sections located in between with a smaller diameter, in other words, the effect-free sections, are called webs. The effect data determining a fancy yarn include, in particular, the effect length, the effect diameter, the effect frequency and the respective effect-free thread length or web length.

Fancy yarns are becoming increasingly important. Areas of use are, for example, denim materials, materials for casual clothing and home textiles.

Fancy yarns can also be produced on rotor spinning machines. In this case, for example, the fiber feed to the opening roller of the rotor spinning mechanism is changed, in that the rotational speed of the draw-in rollers is varied. For this purpose, mechanical gearings are activated, which drive continuous shafts along the machine. The draw-in rollers are made to rotate by means of these shafts. The large mass of the moved parts of a drive system of this type and the gearing play, however, makes it impossible, or only with difficulty, to achieve a precise and abrupt change of the yarn thickness at the beginning and end of an effect. The speed during the spinning of fancy yarn optionally has to be sharply reduced compared to the speed when spinning effect-free yarn.

German Patent Publication DE 44 04 503 A1 describes a rotor spinning machine, in which each draw-in roller with its drive shaft is directly connected to an associated stepping motor. Each stepping motor can be activated by an activation unit. Random speed changes of the fiber band intake can be generated with a random generator. A fancy yarn with predetermined effects cannot be produced with this known rotor spinning machine. However, programs for controlling ring or rotor spinning machines, especially their delivery cylinders, have been developed, with which effects can be adjusted in a targeted manner.

The spinning machine described in German Patent Publication DE 40 41 130 A1, is used for producing fancy yarn using a program control for the effect formation. Specifications such as rotational speed of the drive motors, speeds or specific machine parameters are provided and controlled. For example, for a specific flame or effect type of the fancy yarn to be produced, the rotational speed course of the electric motor is predetermined as a desired value curve. The actual rotational speed is monitored, for example, and recorded in a control device. By maintaining the predetermined rotational speed course, the configuration of the predetermined design of the fancy yarn should be ensured. Deviations from the desired configuration of the fancy yarn, such as may occur despite adhering to specific mentioned specification values, are not recognized in the spinning machine of German Patent Publication DE 40 41 130 A1. This can lead to a reduction in the quality of the fancy yarn or even to the production of reject yarn.

The configuration of the fancy yarn during rotor spinning does not only depend on the control of the draw-in roller, but is also influenced, for example, by the low pressure in the spinning device or by the yarn rotation. It can therefore easily occur that the diverse influencing variables are inadequately coordinated and the configuration of the fancy yarn produced differs from the predetermined configuration of the fancy yarn to an undesired extent. A change in the spinning adjustments on the basis of a visual qualifying checking of the yarn often leads to costly and very time-consuming coordination processes.

SUMMARY OF THE INVENTION

The object of the invention is to propose a method which improves the correspondence of the fancy yarn produced with the predetermined configuration of the fancy yarn.

This object is achieved by an improved method for the production of a fancy yarn, in which an effect configuration is predetermined and data is generated therefrom to represent the selected effect configuration, and in which spinning adjustments are generated based on this data. The present invention is characterized in that once the fancy yarn has been formed in a spinning device, the yarn is guided through a sensor mechanism, and at least one of the parameters, diameter and mass of the fancy yarn is continuously measured by means of the sensor mechanism, the measured values are evaluated, the effect configuration of the yarn produced is determined therefrom and is compared with the predetermined effect configuration, and the spinning adjustments are changed until an adequate correspondence is achieved between the predetermined effect configuration and the effect configuration of the yarn produced.

Advantageous further configurations of the invention are described hereinafter.

Owing to the method according to the invention, a monitoring of the configuration of the fancy yarn is carried out, which allows comparison on the basis of quantified properties of the fancy yarn. Comparison can take place until adequate correspondence with the predetermined configuration of the fancy yarn has been achieved. In other words, it is possible, according to the present invention, to check the result of the respective change of parameters, in a plurality of cycles, and to again introduce a change. In this manner, a yarn can be generated, which substantially corresponds to the predetermined configuration of the fancy yarn.

The correspondence can be checked, in each case, either by statistical recording, in particular recording the effects in tables, in other words, their thickness, length and distribution or else displaying them on a screen. The display on a screen can be carried out, for example, by means of the Oasys® system from Zweigle. A specification in tables in the form of a so-called effect table describes the pattern repeat of the fancy yarn and is described by way of example. Lines with information about the sections configured as a web and with information about the sections of the fancy yarn configured as an effect alternate with one another in the effect table, in each case, one after the other. The first line of the effect table contains information about a web length and the web thickness. The second line contains information about an effect length and an effect thickness. There then follows a line with a web length and web thickness etc. After listing all the predetermined effects and webs in the predetermined sequence, a so-called yarn repeat of the fancy yarn is present.

The summation of all web and effect lengths of the effect table produces the repeat length. In producing the fancy yarn, in accordance with the specification of the first line of the above-described effect table, a web is firstly configured, for example, then an effect according to the specification of the second line of the effect table, followed by a web according to the specification of the third line etc., up to the last line of the effect table. After the last line of the effect table, the cycle starts again with the first line of the effect table. In order to avoid a so-called "image", after multiple repetition of the yarn repeat with an unchanged first line, a yarn repeat with a changed first line can be inserted. The change may be carried out, for example, in the web length or the effect length. As the next yarn repeat after such a so-called "disturbance", a yarn repeat with an unchanged original first line is then selected again. The cycle is repeated with sporadically inserted "disturbances" until the predetermined yarn length is wound on the bobbin. The effect configuration, which is determined with the aid of evaluation of the measured diameter values, is compared with the effect configuration which is predetermined by the effect table. The thicknesses and lengths of the effects and webs listed in the effect table in this case form DESIRED values, the correspondence of which with the measured ACTUAL values is checked.

The continuous measurement of a transverse dimension such as the diameter of the fancy yarn allows an assessment on the basis of quantified properties, as a result of which the comparison can take place in a more targeted and rapid manner compared to a merely qualifying visual assessment. For adaptation to the predetermined configuration of the fancy yarn, changes in the previous data are made. The changing of specific spinning parameters has specific effects on the yarn cross-section. Some parameters can be automatically changed. This is possible, in particular, in the control of the fiber feed to the opening roller by means of control of the draw-in roller. When the draw-in roller temporarily runs more rapidly compared to the rotational speed, which is adjusted to produce a web section, more fiber material is fed per time unit to form the thread. This produces a thicker thread section or an effect. The effect thickness is, in this case, at least approximately proportional to the rotational speed of the draw-in roller. If it is established, for example, that the measured effect thickness is too low, compared with the predetermined effect thickness in the yarn repeat, the rotational speed of the draw-in roller is correspondingly increased. On the other hand, if the measured effect thickness is too great, the rotational speed of the draw-in roller is reduced accordingly. If the evaluation of the measured diameter values of the thread ascertains, for example, that the effect begins too late or the previous web is too long and the length of the effect is therefore not adequate, the beginning of the phase, in which the draw-in roller rotates more rapidly and therefore conveys more fiber material to the opening roller, can be accordingly moved to an earlier point in time. The effect is therefore lengthened. If the effect ends too late and is therefore too long, the end of the phase, in which the draw-in roller rotates more rapidly and therefore conveys more fiber material to the opening roller, can be moved accordingly to an earlier point in time. In the case of deviations of the position, the diameter and the length of the webs, the procedure described above in the case of effects is used.

Further possibilities for changing spinning parameters are known to the person skilled in the art and these affect the yarn cross-section. Thus, by changing the rotor speed, the rotation of the thread and in association with this, the thickness of the thread, can be influenced. In the case of a higher rotation, the thread is more constricted. The adjustment of the low pressure in the spinning device also influences the effect configuration and can be used as a control variable for the effect configuration. Further possibilities for influencing are offered by the choice of the rotational speed of the opening roller and its configuration, in particular its clothing, or the selection of further spinning means, such as, for example, of the spinning rotor. The combing out performance of the opening roller, influencing the effect, is determined both by the type of clothing and by the peripheral speed of the opening roller. Fluctuations or changes in the fiber feed can be implemented more rapidly with an increased rotational speed of the opening roller or more aggressive clothing, which release more fibers from the fiber sample fed through the draw-in roller. At least the direction, in which a change of the spinning parameters has an effect, is known in each case, so in the event of a deviation from the predetermined configuration of the fancy yarn, a reduction can be made in the deviation. The effects of the change are checked by a renewed comparison, with regard to whether it has led to a reduction in the deviation and whether, and optionally in what direction, further changes are to be made in a next step.

Spinning adjustments are to be taken into account which relate to the basic adjustment of the machine, which do not fluctuate, like the directly effect-related data with the changing transverse dimension of the yarn. Thus, for example, a change in the rotation coefficient can change the thickness of the yarn section. The combing out performance of the opening roller influencing the effect is determined both by the type of clothing and also by the peripheral speed of the opening roller. If such spinning adjustments are included in the comparison process, the possibilities are improved of rapidly reaching optimally selected or adjusted spinning parameters.

By storing the spinning adjustments after comparison, renewed production of the optimized yarn is possible again at any time, the reproducibility being very good.

The data to be fed again to the rotor spinning machine is effective for various control mechanisms. The data accordingly contains addresses of control mechanisms, for which it is intended. This leads to the intended allocation of the data when downloading. This also includes data which is only displayed on a display of the central control mechanism. This relates, in particular to data which cannot be implemented by the machine itself. The selection of the spinning means is mentioned by way of example.

According to further features of the invention, a method for evaluating the measured yarn values is carried out to determine the effects, with the aid of which it is possible to characterize the configuration of the effects produced and to compare these effects with those which are specified, for example, in table form, in an effect table.

The change to achieve adequate correspondence between the predetermined effect configuration and the effect configuration of the yarn produced advantageously takes place as a control process, which is assisted by the use of control algorithms and empirically determined spinning adjustments, in table form. Both control algorithms and empirically determined spinning adjustments in table form are used to shorten the control process by targeted changes.

In the method according to the invention, the monitoring of the threads produced is selected as the object. By comparing the effect configuration of the fancy yarn produced with the desired effect configuration predetermined for the yarn, the degree of correspondence or deviation is ascertained. For the further yarn production, ascertained deviations from the desired effect configuration are minimized adequately or completely eliminated by means of the control process. The control process is based on the ACTUAL effect configuration in this case. On the other hand, as in known methods, if only the adherence to the specifications for the feeding of fiber material is monitored, this entails disadvantages. If the fiber material feed, which is supplied for the fancy yarn formation in the form of fiber bands or roving, is controlled without consideration of the ACTUAL effect configuration, other disturbance variables and their effect on the effect formation of the fancy yarn produced are not recognized.

This defect is avoided in the method according to the invention. The control process is based, in this case, on the ACTUAL effect configuration. Thus every deviation occurring owing to the influence of disturbance variables, of the ACTUAL effect configuration from the desired effect configuration becomes recognizable. An effective control process can be carried out in this manner. When changing the draw-in speed during the feeding of the fiber material or the draw-off speed of the fancy yarn produced, these two speeds are matched to each other in such a way that the effect image corresponds to the desired effect configuration, as a result.

The method according to the invention will be described with the aid of a rotor spinning machine.

DETAILED DESCRIPTION OF THE PREFERRED EMBODIMENTS

Figure 1:
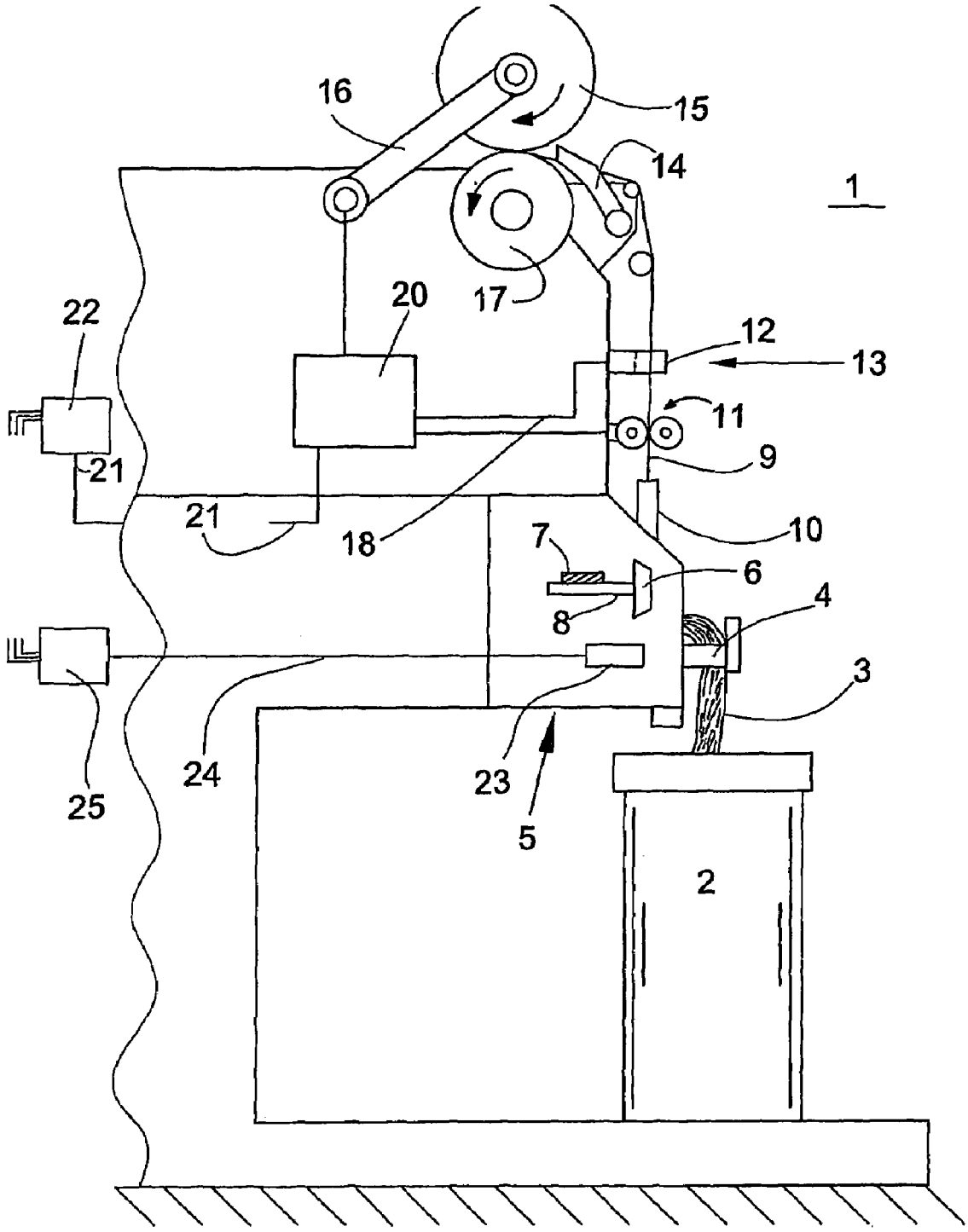
FIG. 1 shows a basic view of a spinning station.

Of the large number of spinning stations of a rotor spinning machine, a single spinning station 1 is shown in side view. At the spinning station 1, a fiber band 3 is drawn in from a fiber band can 2 through a so-called condenser 4 into the spinning box 5 of the rotor spinning mechanism. The mechanism arranged in the spinning box 5 for isolating the fibers and feeding them into the spinning rotor 6 are known from the prior art and therefore not described in more detail. The drive of the spinning rotor 6 is indicated and consists of a belt 7 running along the machine, with which all the rotors of the spinning stations installed on one longitudinal side of the spinning machine are driven. Nevertheless, single drives of the rotors are alternatively also possible. The belt 7 rests on the rotor shaft 8 of the spinning rotor 6.

Figure 2:
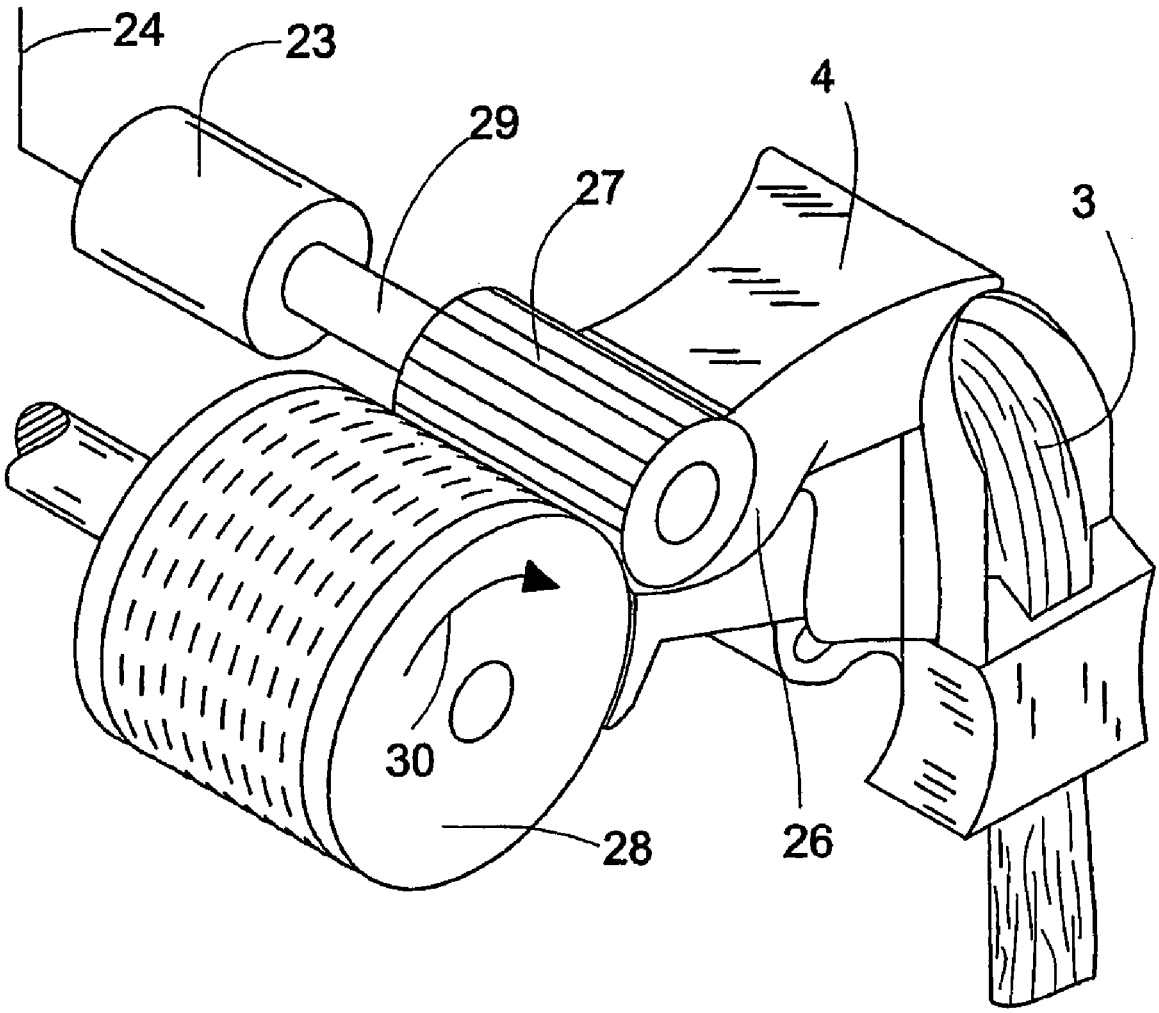
FIG. 2 shows the opening mechanism of a spinning station in a simplified basic view, in a partial view.

The thread 9, which is drawn off by means of the draw-off rollers 11 through the thread draw-off tube 10 is formed in the spinning rotor 6. The thread 9 then passes a sensor 12, which is part of a so-called clearer 13 for monitoring the quality of the thread 9. To recognize a yarn defect, the measured diameters are detected in relation to the thread length passing through. On recognizing a yarn defect, the rotation of the draw-in roller 27 shown in FIG. 2 is stopped, for example, and a thread interruption is thus caused. The thread 9 is guided by a thread guide 14 in such a way that it is wound in cross-wound layers onto a cross-wound bobbin 15. The cross-wound bobbin 15 is carried by a bobbin holder 16, which is pivotably mounted on the machine frame. The cross-wound bobbin 15 rests with its periphery on the winding drum 17 and is driven thereby such that the thread 9 is wound in cross-wound layers in cooperation with the thread guide 14. The rotational directions of the cross-wound bobbin 15 and the winding drum 17 are indicated by arrows. The sensor 12 is connected to a local control unit 20 of the spinning station via the line 18. The control unit 20 is connected to a central computer 22 of the rotor spinning machine via the line 21. The stepping motor 23 of the draw-in roller is connected to the control mechanism 25 via the line 24.

FIG. 2 shows details of the opening of the fiber band 3 into individual fibers. The fiber band 3 drawn in through the condenser 4 is clamped between the clamping table 26 and the draw-in roller 27 and presented to the rapidly rotating opening roller 28. The draw-in roller 27 is connected to the stepping motor 23 via the drive connection 29. The stepping motor 23 can be activated via the line 24. The direction of rotation of the opening roller 28 is indicated by the arrow 30.

Figure 3:
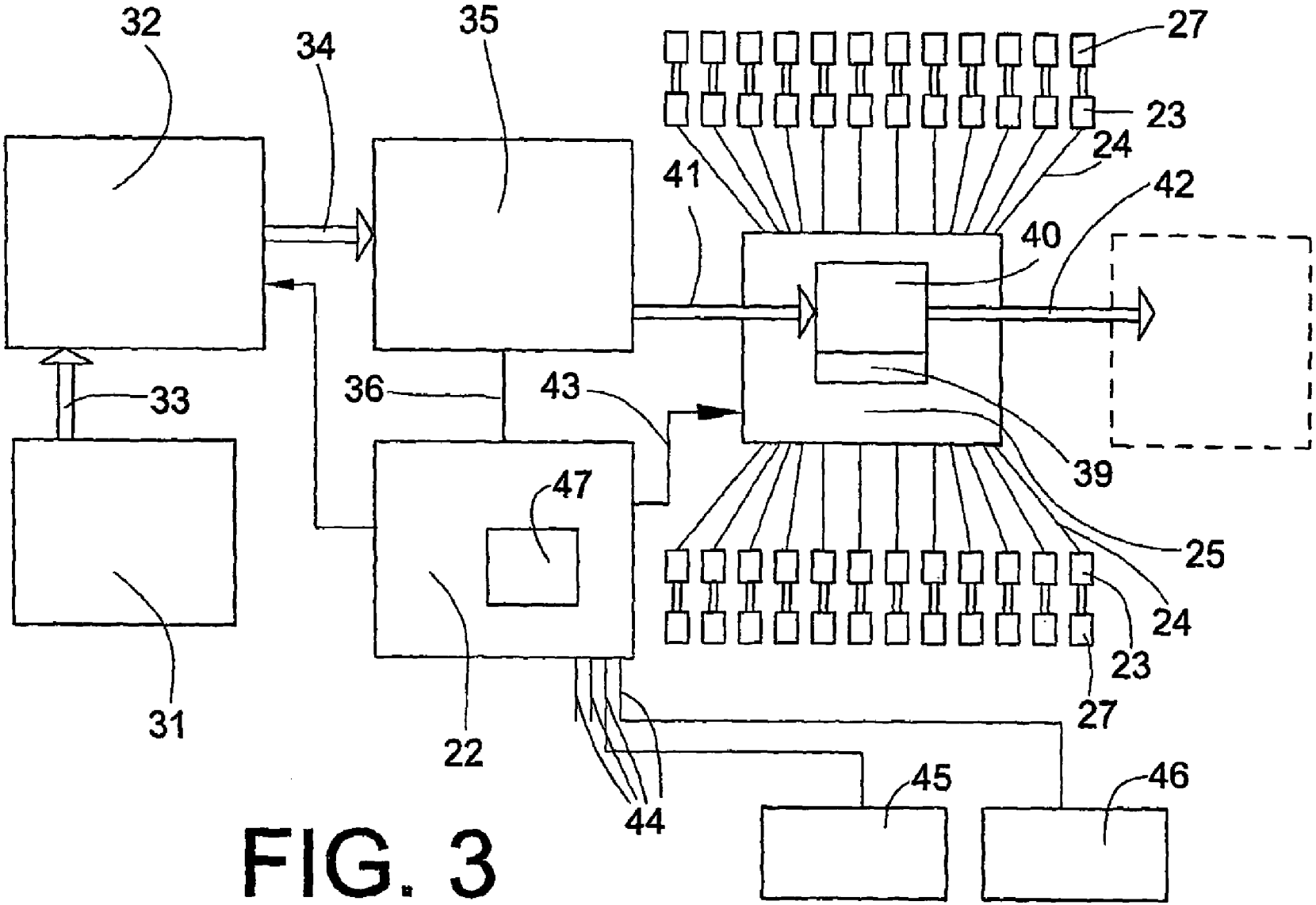
FIG. 3 shows a basic view of the control, in particular of draw-in rollers of a rotor spinning machine.

The basic structure of a draw-in roller control is shown schematically in FIG. 3.

In the present example, the diameter of the presented yarn is measured. As an alternative, for example, the yarn mass could be determined by means of a capacitive sensor instead of an optical one. During determination of the yarn mass, which is generally taken as a basis for the determination of the yarn fineness, the mass of a yarn section passing the measuring region is measured, while during the optical measurement, an average diameter value is determined inside the measuring region. The two measurements are equally suitable for evaluating the effect configuration. In the present example, the invention is described by means of determining the diameter, however.

Firstly, the configuration of the fancy yarn is input or read into a schematically shown input mechanism 31 and this data is transmitted to a yarn design unit 32. The transmission is indicated by the arrow 33. The data required for spinning on a rotor spinning machine are generated in the yarn design unit 32 by means of yarn design software. This data includes both the directly effect-related data, which fluctuates with the changing diameter of the yarn and further data relating to the basic adjustment of the rotor spinning machine. This involves, for example, the rotor, draw-off roller and opening roller speed and the selection of the spinning means. While the latter are preferably retrieved from a table, the rotational speeds are to be determined by corresponding algorithms. These algorithms are based on known interconnections. This involves, for example, the determination of the drawing from the ratio of the rotational speeds of the draw-off rollers to the rotational speed of the draw-in rollers, or of the rotations per meter from the rotor speed in relation to the draw-off speed and the constriction of the fiber assembly connected thereto.

The data generated in the yarn design unit 32 is transmitted to a central control mechanism 35 of the rotor spinning machine via a bus system 34. Transmission may also take place alternatively with transportable data carriers, such as, for example, a compact flash card.

The central control mechanism 35 is connected to the central computer 22 via the data line 36.

The control mechanism 25 comprises the control of 24 stepping motors 23, for example, of the respective draw-in rollers 27 via lines 24. All 24 winding stations are constructed in the same manner. A control card 40 is connected onto the control mechanism 25 by means of a connection device 39. The data required to produce fancy yarn is transmitted, for the control of the stepping motors 23, via a bus system 41 from the central control mechanism 35 to the control card 40. To produce fancy yarn, the control card 40 converts the data about the thickness and length of the effects and the webs, with adaptation to the other spinning adjustments, into control data for the stepping motors 23 to generate the rotational movement of the draw-in rollers 27. Via the bus system 42 as a continuation of the bus system 41, the data required to control the stepping motors of the draw-in rollers is transmitted to further control cards, not shown, which are connected to control mechanisms of further sections of the rotor spinning machine. One of the further control mechanisms is indicated by dashed lines. The further control mechanisms are constructed like the control mechanism 25, have an identical connection device and a connected, identical control card. Each further control mechanism in each case controls the spinning stations of a section of the rotor spinning machine formed from 24 spinning stations.

If the stepping motor 23 is activated in such a way that it runs more rapidly, the draw-in roller 27 transports more fiber material to the opening roller 28. This results in the fact that more fiber material arrives, per time unit, in the rotor 6 and the spun thread becomes thicker. The length of the thick location depends on the duration of the increased fiber feed. The diameter of the thick location depends on the speed of the stepping motor 23 or the draw-in roller 27.

The control mechanism 25 is also activated by the central computer 22 via the line 43, with it being specified via control commands whether the control mechanism 25 controls the production of a fancy yarn or the production of effect-free yarn.

The freshly spun yarn is measured out by the sensor 12 and the measured values are transmitted to the yarn design unit 32, which is also provided with a display, not shown, in order to reproduce the current fancy yarn or to quantify deviations from the specification. If the appearance or the statistical description of the freshly spun yarn does not correspond to the predetermined configuration of the fancy yarn, further changes have to be made. These changes may consist both in changing the effect parameters, which are input in the yarn design unit and also in changing machine parameters, which are to be input as a rule at the central computer 22. For this purpose, control connections 44 are available at the central computer, which, for example, can lead to a control mechanism 45 for the draw-off rollers 11 or a control mechanism 46 for the spinning rotors 6, the control mechanisms 45 and 46 being formed, for example, by a frequency converter. A display 47 at the central computer also shows the selected spinning means, which, as already mentioned, have a not inconsiderable influence on the configuration of the effects.

Figure 4:
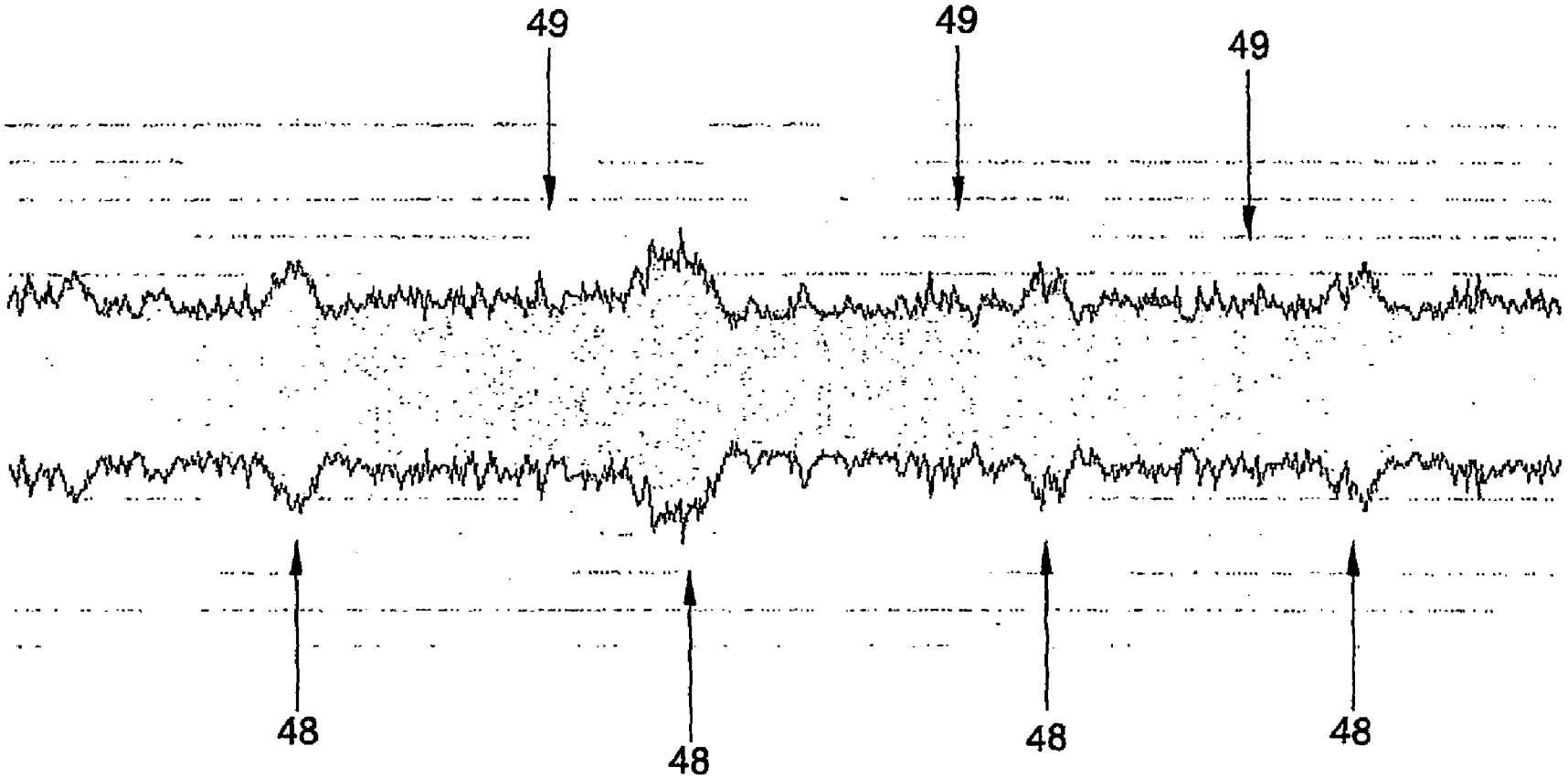
FIG. 4 shows a fancy yarn, which is shown by the placing side by side of measured values of the yarn diameter

FIG. 4 shows a view of the fancy yarn as a placing side by side of measured values. The effects 48 and webs 49 can be recognized, but the beginning and end of the effects 48 and the effect thickness or the effect diameter $D_E$ and the web thickness or the web diameter $D_{ST}$ cannot be seen clearly and therefore not adequately.

Figure 5:
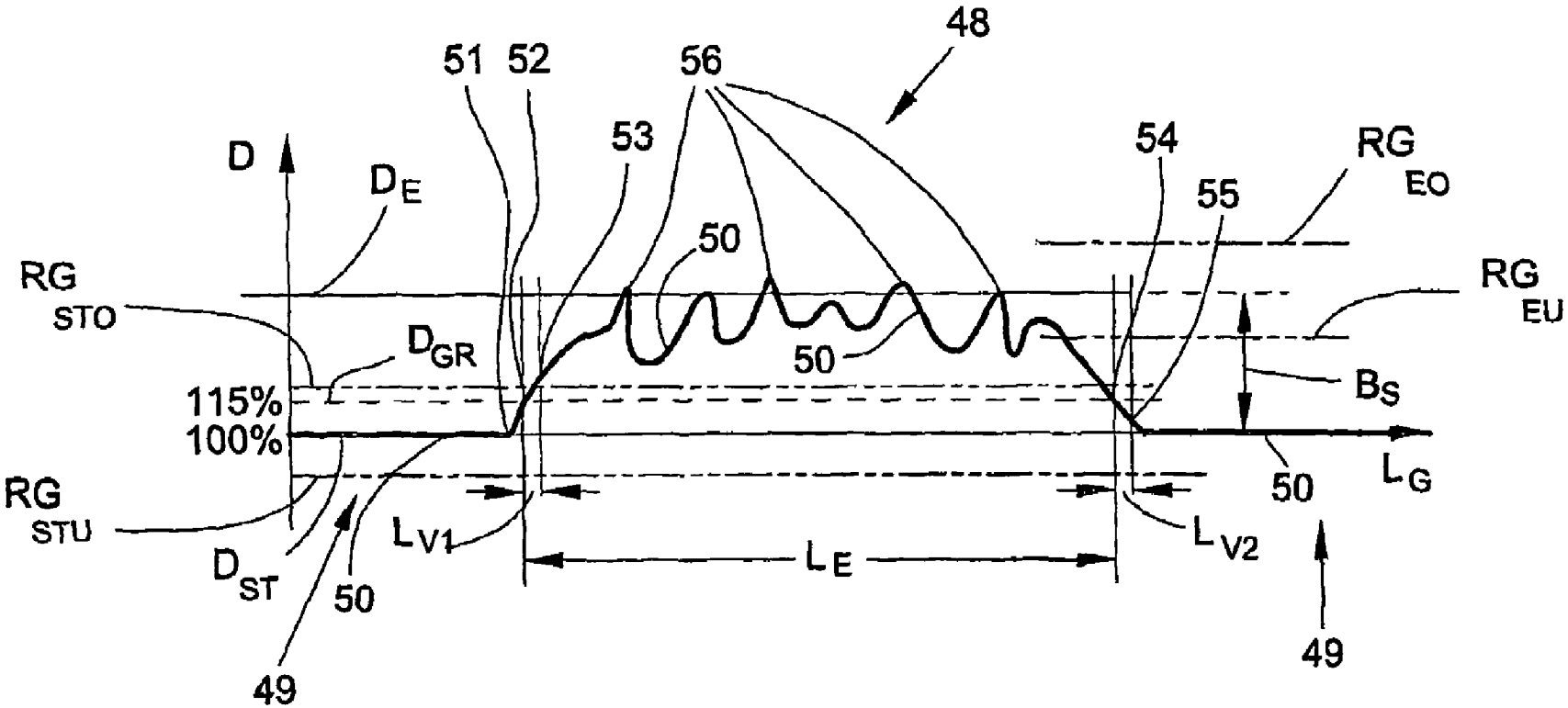
FIG. 5 is a basic view of a fancy yarn.

The sensor 12 continuously measures the yarn diameter D and transmits the measured data for evaluation via the central computer 22 to the yarn design unit 32. The yarn diameter D is recorded in each case after 2 mm of yarn length. A cycle represents a measuring length of 2 mm of yarn. In the view of FIG. 5, the limit diameter D is shown as a percentage over the yarn length Ls as a curve 10. The curve 50 represents the web diameter $D_{ST}$ in the view of FIG. 5, beginning from the left up to the point 51. From the point 51, the curve 50 rises and passes the value of the limit diameter $D_{GR}$ at the point 52. At point 53, the predetermined yarn length $L_{V1}$ has been passed through since reaching the point 52. Since an increase in diameter of 15% is recorded at point 52 and the exceeding of the limit diameter $D_{GR}$ lasts over the predetermined length $L_{V1}$, for example, six cycles or 12 mm, the point 52 is defined as the beginning of the effect. The curve 50 falls below the limit diameter $D_{GR}$ at point 54. The falling below lasts to the point 55 and therefore over the predetermined length $L_{V2}$. Therefore, the point 54 is defined as the end of the effect. The effect length $L_E$ is determined from the beginning and end of the effect between point 52 and point 54. An arithmetic average value is formed from the four largest diameters 56 inside the effect. Thus the information about the effect diameter is very largely independent of natural diameter fluctuations in the effect region. This arithmetic average value is defined as the effect diameter $D_E$.

The yarn clearer 37 continuously determines whether the diameter values of the thread 9 detected by the sensor 12 derive from a region which is defined as a web 49 or as an effect 48. The fluctuation width $B_S$ designates the spacing between the diameter of the effect 48 and the diameter of the web 49. If the diameter values of the thread 9 derive from a region, which is defined as a web 49, these diameter values are compared with the limit values, the limit value $RG_{STO}$ and the limit value $RG_{STU}$, associated with the web diameter $D_{ST}$. If the diameter values of the thread 9 derive from a region, which is defined as an effect 48, these diameter values are compared with the limit values, the limit value $RG_{EO}$ and the limit value $RG_{EO}$, associated with the effect diameter $D_E$.

The limit values are selected in such a way that exceeding them signifies an intolerable deviation. An intolerable deviation triggers a change in the spinning parameters. If, for example, an effect does not have the correct dimension, because the thickness of this effect is too low, the thread feed for the phase, in which this effect is formed, is raised by means of an increase in the rotational speed of the draw-in roller and the deviation from the predetermined effect thickness is reduced or eliminated in this manner.

The yarn clearer 37 can be set up in such a way that, alternatively, either only deviations in the web regions or only deviations in the effect regions are taken into account.

According to the checking of the diameters of the thread 9, the web length and the effect length can also be compared with predetermined lengths, without there being an exceeding of diameter limit values, and with the aid of length limit values, a decision can be made as to whether intolerable deviations are present.

The invention claimed is:

1. Method for the production of a fancy yarn, in which an effect configuration is predetermined and data is generated therefrom, which represents the selected effect configuration, and in which spinning adjustments are generated based on this data, characterized in that once it has been formed in a spinning device, the fancy yarn is guided through a sensor mechanism, and at least one of the parameters, diameter and mass of the fancy yarn is continuously measured by means of the sensor mechanism in that the measured values are evaluated and the effect configuration of the yarn produced is determined therefrom and is compared with the predetermined effect configuration and in that the spinning adjustments are changed until an adequate correspondence is achieved between the predetermined effect configuration and the effect configuration of the yarn produced.

2. Method according to claim 1, characterized in that the spinning adjustments included in the comparison process, which, apart from the directly effect-related data, which fluctuate with the changing transverse dimension of the yarn, also contain further data relating to the basic adjustment of the spinning machine.

3. Method according to claim 2, characterized in that on conclusion of the comparison process, the spinning adjustments are stored on a storage medium for renewed production of the fancy yarn.

4. Method according to claim 1, characterized in that the data is provided with addresses and is addressed to the control units (22, 25, 35, 45, 46) provided, in each case, for the corresponding control operations.

5. Method according to claim 1, characterized in that the effect region is determined in that the beginning of the effect is defined by meeting a first criterion and in that the end of the effect is defined by meeting a second criterion, in that an ascertainable number of largest measured values is determined between the beginning and the end of the effect, in that an average value is formed from the determined measured values, which represents the transverse dimension of the effect, and in that the effect length is determined from the beginning and end of the effect.

6. Method according to claim 5, characterized in that the transverse dimension of the web $D_{ST}$ is determined in order to determine the relative transverse dimension of the effects.

7. Method according to claim 5, characterized in that, to determine the transverse dimension of the web $D_{ST}$, an arithmetic avenge value of the transverse dimension of the yarn is firstly formed from a predetermined length of yarn, as the reference, in that the reference value is subtracted from the individual values of the transverse dimension of the yarn, and in that the transverse dimension $D_{ST}$ the web $D_{ST}$ is then formed as the arithmetic average value from all the negative values which were measured adjacent to other negative values.

8. Method according to claim 5, characterized in that the transverse dimension $D_E$ of the effect is fanned as the average value from the four largest transverse dimensions between the beginning and end of the effect.

9. Method according to claim 5, characterized in that, considered as the first criterion, is the exceeding of a limit value of the transverse dimension $D_{GR}$, which is gi-eater by a defined amount than the transverse dimension of the web $D_{ST}$, and in that the exceeding lasts over a predetermined yarn length $L_{V1}$ and in that, considered as the second criterion, is the falling below of the limit value $D_{GR}$ and that the falling below lasts over a predetermined yarn length $L_{V2}$.

10. Method according to claim 9, characterized in that the limit value $D_{GR}$ is 15% greater than the transverse dimension of the web $D_{ST}$.

11. Method according to claim 9, characterized in that the predetermined yarn length is assumed to have been reached when the criterion is met over six consecutive measured values.

12. Method according to claim 5, characterized in that when measuring the transverse dimension of the web, a measured value is detected every two millimeters.

13. Method according to claim 1, characterized in that the change to achieve an adequate correspondence between the predetermined effect formation and the effect formation of the yarn produced takes place as a control process, which is assisted by the use of control algorithms and empirically determined spinning adjustments in table form.

14. Method according to claim 2, characterized in that the spinning adjustments contain data relating to the rotor speed.

15. Method according to claim 2, characterized in that the spinning adjustments contain data relating to opening roller speed.

16. Method according to claim 2, characterized in that the spinning adjustments contain data relating to selection of the spinning means.

* * * * *